US006183016B1

(12) United States Patent
Parker

(10) Patent No.: US 6,183,016 B1
(45) Date of Patent: Feb. 6, 2001

(54) LABELING INSULATION TAPE

(76) Inventor: Philip A. Parker, Rte. 2, Box 2264, Naples, TX (US) 75568

( * ) Notice: Under 35 U.S.C. 154(b), the term of this patent shall be extended for 0 days.

(21) Appl. No.: 09/522,960

(22) Filed: Mar. 10, 2000

Related U.S. Application Data

(60) Provisional application No. 60/143,834, filed on Jul. 14, 1999.

(51) Int. Cl.[7] ..... B42D 15/00
(52) U.S. Cl. ..... 283/70
(58) Field of Search ..... 283/67, 70, 81, 283/117, 101, 105; 156/498, 579; 364/468

(56) References Cited

U.S. PATENT DOCUMENTS 4,098,636 * 7/1978 Gabriel ..... 156/498
5,129,985 * 7/1992 Crowley ..... 156/579
5,491,637 * 2/1996 Kraemen et al. ..... 364/468

OTHER PUBLICATIONS

Seton, Identification Products product catalog, winter/spring 2000.

MSI Marking Services Incorporated, Pipe Markers & Mechanical Identification product catalog, 1997.

Craftmark Identification Systems, Pipe Identification product catalog, 1999–2000.

* cited by examiner

*Primary Examiner*—Willmon Fridie, Jr.
(74) *Attorney, Agent, or Firm*—Jones, Day, Reavis & Pogue

(57) ABSTRACT

An invented Labeling Insulation Tape that combines a conventional insulation tape with pipe identification markings or lettering. According to one embodiment, the identification markings are repeatedly printed onto the tape in a continuous form fashion creating on the tape a series of individual label sections. Conventional printing techniques are used in the printing of the tape. The labeling insulation tape is then cut and rolled into convenient-to-use lengths. Alternate embodiments include the tape being cut into lengths equal to individual labels and a long roll of peel-off backing with a multiplicity of individual label releasably adhered thereto.

27 Claims, 2 Drawing Sheets

LABELING INSULATION TAPE

CROSS-REFERENCES TO RELATED APPLICATIONS

This application claims priority from the following application Provisional Application No. 60/143,834, filed Jul. 14, 1999.

BACKGROUND OF THE INVENTION

1. Field of the Invention

This invention is in the field of piping identification labels and markings.

During plumbing and mechanical construction, it is typical for installers of piping systems to identify the systems. These piping systems are normally identified as to the type of fluid or gas they carry as well as the direction of flow. Standard colors, names, sizes, and markings are used to identify the various types of piping systems so as to conform to industry standards for piping system identification. Several conventional methods are commonly used to identify these piping systems.

2. Description of Related Art Including Information Disclosed Under 37 CFR 1.97 and 1.98

One common method of identifying the type of piping system and direction of flow is to adhere a pipe label to the exterior surface of the pipe. These labels typically have a self-adhesive peel-offbacking. These types of labels are generally made of vinyl, polyester or other types of plastics. They are color coded to meet industry standards and appropriately sized to match the size of the identified pipe. These labels usually have black or white lettering with the appropriate background color so that the piping can be readily identified from a distance. Labels also are used that have arrows to identify the direction of flow. Though economical to use there is a disadvantage in using the labels to identify insulated piping systems having a covering or jacket. They do not adhere well to the insulation jacket and over a period of time these types of pipe labels can often peal away from the insulation jacket.

Another method of identifying the type of piping systems and direction of flow is to attach a hard plastic label to the surface of the pipe. These types of labels are commonly referred to as a "Wrap-Around Label". They bond to the pipe by contracting around it because they are formed in a cylinder shape with one side being overlapping and not connected. Once place around the pipe they compress and fit snuggly around it. They are also attached to the pipe by utilizing a form of banding similar to nylon ties. Though these "Wrap-Around Labels" are durable, they are also expensive to use.

Another commonly employed method of labeling piping systems is to paint the lettering and arrows onto the pipe. This method is most commonly referred to as stenciling. A stencil containing the appropriate lettering to correctly identify the pipe is placed next to the pipe surface. Paint or ink is then applied by either spray or brush techniques. Once the label is removed, the proper lettering will appear on the pipe's surface. Direction arrows are likewise stenciled upon the surface of the pipe. Though this method can be the least expensive, it still has its disadvantages. To properly identify several different piping systems, it becomes necessary for a worker to carry about a given area several different stencils and colors of paint. To properly identify all but a limited number of pipes, the process becomes very costly. Also, a good quality of the lettering is often difficult to achieve with field applied labeling or stencils. This is because the pipes to be stenciled are often in hard to get to locations such as being located in ceiling spaces.

There is presently a readily available pipe insulation that is comprised of hardened fiberglass insulation with an outer covering or jacketing. This insulation is commonly referred to as jacketed pipe insulation. This jacketed insulation is typically available in short sections and placed about piping systems in these sections. These sections of jacketed insulation require joining and sealing.

There is also presently available an insulation tape that is used in the joining and sealing of this jacketed pipe insulation. This tape has a jacket that is similar to, and made of substantially the same material as the jacketed insulation. The tape has a foil back and a peel-off adhesive backing. It is generally available in roll form but can also be obtained in short individual strips sized for the pipe insulation to be sealed. The joining or sealing of sections of jacketed insulation with this tape is accomplished by first cutting a strip of the tape and then peeling away the backing. Placing the tape around the insulation or along a side seam, and then by applying hand pressure, the tape is adhered to the jacketed pipe insulation. This process seals joints in the sections of the jacketed pipe insulation. Further, the jacketed pipe insulation has a smooth finish and appearance.

SUMMARY OF THE INVENTION

The invented Labeling Insulation Tape is a pipe insulation tape on which pipe identification markings or lettering is printed. The identification markings are repeatedly printed onto the tape in a continuous form fashion. Conventional printing techniques are used in the printing of the tape. The labeling insulation tape is then cut and rolled into convenient-to-use lengths. The invention is one of new use of existing products and new methods. Though not before thought possible, by combining conventional insulation tape with conventional printing methods the invented labeling insulation tape now allows for a pipe identification marking method that is more suited than prior marking techniques for use on jacketed fiberglass insulated piping systems. More specifically, the present invention discloses a method of providing identifying markings on pipes in a piping system covered by insulation having an outer jacket. The method comprises the steps of providing a length of conventional pipe insulation tape having an exterior layer made of material substantially the same as the outer jacket of the insulation. The back side of the exterior layer is covered by an adhesive layer for permanently adhering the tape to the outer jacket of the insulation. A peel-off backing covers and protects the adhesive layer. A selected identifying mark is printed or otherwise provided on the front side of the insulation tape. To apply a label, the peel-off backing is simply removed and the adhesive layer is placed in contact with the insulation outer jacket creating a permanent bond between the tape and the outer jacket of the insulation.

Accordingly, it is an objective of the present invention to provide identification labeling for piping systems having jacketed fiberglass insulation that better adheres to the surface of the insulation jacket.

It is another objective of the invention to provide identification labeling for piping systems having a jacketed fiberglass insulation that gives the appearance of being a field applied stencil.

Still another objective of the invention is to provide identification labeling for piping systems having jacketed fiberglass insulation which is easy to apply.

Another objective of the invention is to provide labeling requiring minimal labor costs.

BRIEF DESCRIPTION OF THE DRAWINGS

These and other features of the present invention will be more fully disclosed when taken in conjunction with the following Detailed Description of the Invention in which like numerals represent like elements and in which.

DETAILED DESCRIPTION OF THE INVENTION

Figure 1A:
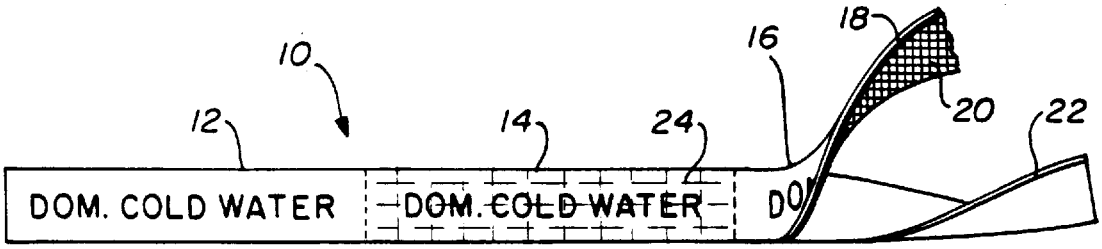
FIG. 1A illustrates how the labeling insulation tape is comprised of an exterior layer, an adhesive coating and a peel-off backing in an embodiment where the exterior layer is printed in a continuous form with words or other markings repeated along its surface.
Figure 1B:
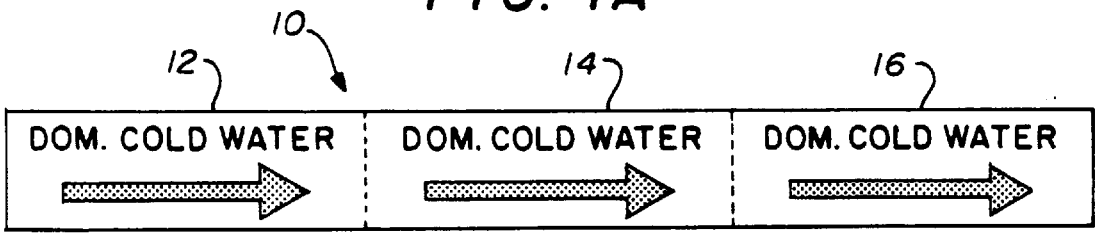
FIG. 1B shows the same labeling insulation tape in instances where directional arrows have been included in the printed.
Figure 1C:
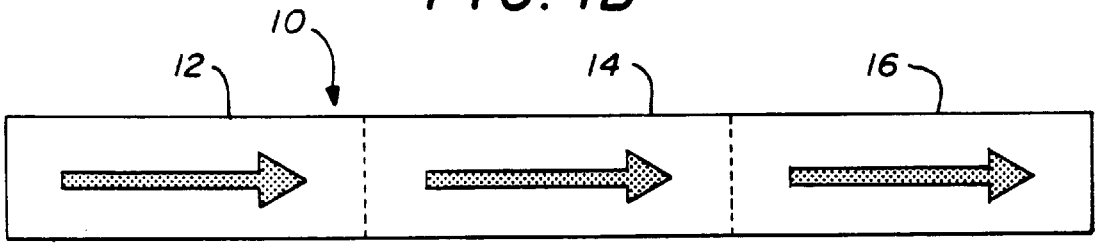
FIG. 1C demonstrates that the labeling insulation tape can be printed only with directional flow arrows and without lettered markings.

The Labeling Insulation Tape of this invention is a conventional pipe insulation tape on which pipe identification markings are printed using conventional printing methods and colored inks or paints. As illustrated in the embodiments of FIGS. 1A through 3, identification markings or other information is repeatedly printed onto individual label sections of the tape in a continuous fashion. For example, FIG. 1A identifies the type of fluid flowing in the pipe. Similarly, as shown in FIGS. 1B and 1C, flow arrows and other identifying marks and symbols may be printed onto the tape as well. As shown generally at 10 in FIGS. 1A through 3, individual label sections 12, 14 and 16 can be printed in various sizes and colors so that the size of the identification marking is appropriately sized with the pipe sized to which it is adhered and the color of the identifications match industry standards for pipe identification.

Referring again to FIG. 1A, there is also shown a pictorial view of the construction of the conventional insulation tape used in this invention. As shown, there is included an exterior layer 18 on which the identifying markings are provided on the front surface. An adhesive layer 20 is coextensive with and securely bonded to exterior layer 18. The adhesive layer 20 is selected to permanently bond with the outer jacket of conventional pipe insulation once applied. A peel-off backing 22 for protecting the adhesive layer 20 is releasably adhered thereto. As will be appreciated by those skilled in the art, the peel-off backing 20 is removed just before application of a label to the outer layer of the pipe insulation. There are various sources of commercially available tape used for sealing pipe insulation. One particularly suitable tape manufactured by Venture Tape in Rockland, Massachusetts, has an exterior layer 18 made of "kraft" paper with reinforcing threads as indicated at 24 in section 14 of FIG. 1A. An alternate type of exterior layer 18 is made of "kraft" paper bonded to aluminum foil with or without the reinforcing threads.

Figure 2:
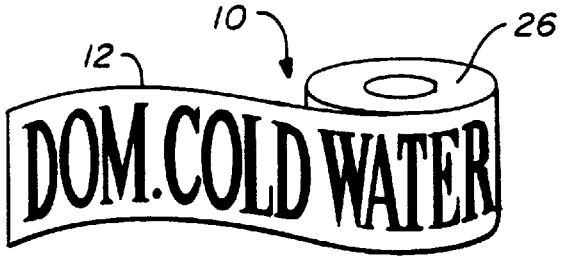
FIG. 2 illustrates a single roll of the labeling insulation tape.
Figure 3:
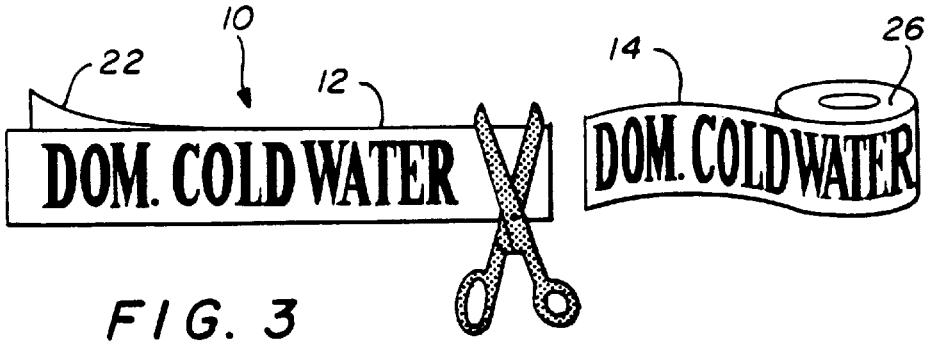
FIG. 3 demonstrates the technique of removing individual sections of the labeling insulation tape from the roll.

As shown in FIG. 2 and according to one embodiment, a long strip of the labeling insulation tape is rolled into convenient-to-use lengths. FIG. 3 shows one typical method of removing an individual label section 12 from the roll 26 by severing or cutting the individual label section 12 from the roll 26. The peel-off backing 22 is then removed from the individual label section 12.

Figure 4:
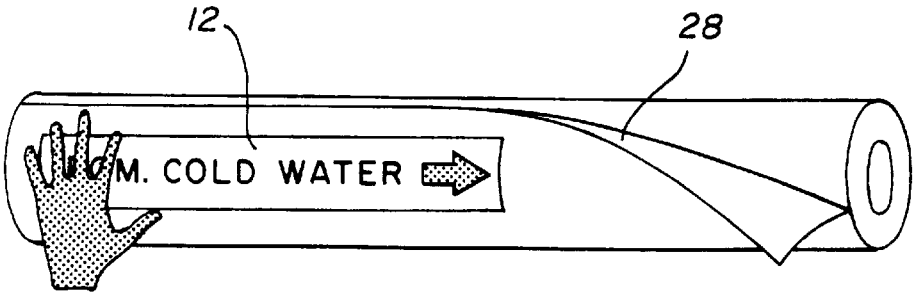
FIG. 4 illustrates a technique of applying the labeling insulation tape onto the jacketed surface of pipe insulation.

As shown in FIG. 4, the individual label section 12 is then adhered to the pipe insulation jacket 28 by applying hand pressure.

Figure 5:
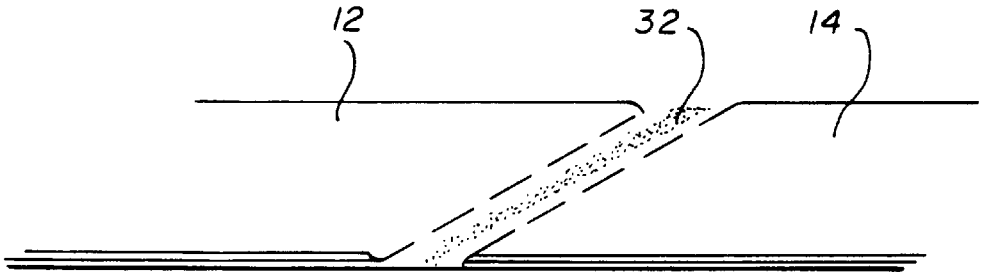
FIG. 5 illustrates pre-cutting or the perforating of the individual label sections of the tape.
Figure 6:
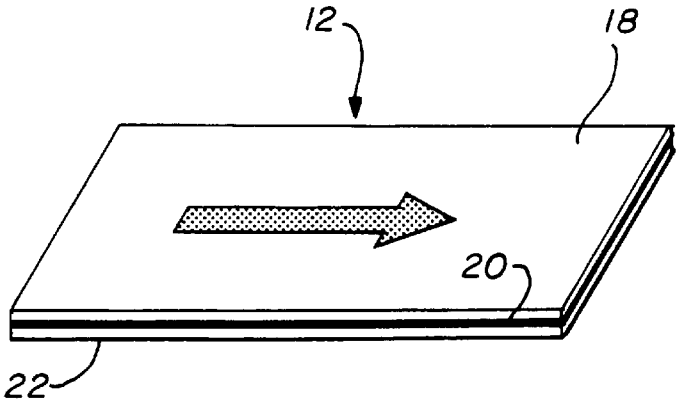
FIG. 6 illustrates the insulation tape of this invention provided on individual label sections rather than as a continuous labels on a roll.

Additional embodiments are shown in FIGS. 5 and 6. According to FIG. 5, a length or roll 26 of the tape is shown with a "pre-cut" or perforation 30 between individual label sections 12 and 14 on the roll 26. The peel-off backing 22, however, is still a long continuous trip that may or may not include perforations 32.

FIG. 6 shows an individual label section cut for individual packaging rather than a multiplicity of the labels being placed on a single roll.

There are various possibilities with regard to the method of applying the lettering and other identifications to the insulation tape including conventional printing techniques well known in the printing art such as screen printing, roll printing, sheet printing and digital printing. In addition, variation of sizes, shapes, and colors of identification markings of the invention can differ with regards to use with different insulated piping systems and the identification thereof. Likewise, the tape can be printed with a background of the appropriate color to identify the piping system with the identification markings being printed with a contrasting color.

From the description above, a number of advantage of my labeling insulation tape become evident:

a) The individual label section is easy to remove from the roll and apply upon jacketed fiberglass insulation.

b) It more readily adheres to the surface of the insulation jacket.

c) In appearance, it resembles "in-the-field" painted stenciling.

d) The appearance of field applied high quality stencils gives the piping system a professional finished look.

e) The installation time to apply the invented labeling tape is similar to that of the peel-off pipe labels so labor costs are minimal.

The manner of using the Labeling Insulation Tape follows. Since a roll of Labeling Insulation Tape has many individual label sections such as sections 12, 14, 16, etc., once they are cut from the roll, they are adhered to the insulation jacketing 28 by removing the peel-off backing 22 and positioning the tape onto the jacketing and applying hand pressure. As shown in FIG. 6, the "pre-cuts" permit individual label sections to be removed more easily.

Accordingly, the labeling insulation tape can be used to identify the nature of piping systems having jacketed insulation. The individual label sections can easily be removed from the roll and applied to the insulation jacket. Because they are made of like materials as the insulation jacket and have a compatible adhesive backing, the advantages of their use as described is superior over other types of applications. For example, the applied label section gives the appearance of an "in-the-field" painted stencil that is of high quality.

In addition, variation of sizes, shapes, and colors of identification markings of the invention can differ with regards to different insulated piping systems and the identification thereof.

The corresponding structures, materials, acts, and equivalents of all means or step plus function elements in the claims below are intended to include any structure, material, or act for performing the function in combination with other claimed elements as specifically claimed.

What is claimed is:

1. A method of identifying piping systems covered by insulation having an outer jacket comprising the steps of:

providing a roll of conventional pipe insulation tape suitable for primarily adhering to said outer layer of said insulation tape, said tape having an exterior layer with a front side and a back side and made of material substantially the same as the outer jacket of said pipe insulation, an adhesive layer for permanently adhering said tape to said outer jacket of said pipe insulation coextensive and releasably adhered to said back side of said exterior layer and a peel-off backing covering said adhesive layer;

repeatedly placing at least one selected identification marking on along the length of said outter layer of insulation tape;

dividing said roll into selected lengths; and removing said peel-off backing from said adhesive layer of one of said selected lengths and permanently adhering said length of insulation tape with at least one selected identification marking to said outer jacket at a selected location of said insulation covering said piping system.

2. The method of claim 1 wherein said peel-off backing is coextensive with said outer layer and said adhesive layer.

3. The method of claim 1 wherein said dividing step comprises cutting a portion of said roll with at least one of said repetitive markings prior to said removing and adhering steps.

4. The method of claim 1 wherein said peel-off backing has a length at least equal to a multiplicity of said selected length, and a multiplicity of said exterior layers of said selected lengths representing a single label are releasably adhered to said length of peel-off backing.

5. The method of claim 1 wherein said step of placing identification markings on said front side of said exterior layer is by a conventional printing technique.

6. The method of claim 5 wherein said printing technique is roll printing.

7. The method of claim 5 wherein said printing technique is screen printing.

8. The method of claim 5 wherein said printing technique is sheet printing.

9. The method of claim 5 wherein said printing technique is digital printing.

10. The method of claim 1 wherein said exterior layer is kraft paper.

11. The method of claim 1 wherein said exterior layer is kraft paper bonded to aluminum foil.

12. The method of claim 1 wherein said identifying markings are letters.

13. The method of claim 1 wherein said identifying markings are directional arrows.

14. The method of claim 1 wherein said identifying markings are a combination of letters and flow arrows.

15. The method of claim 3 wherein said step of dividing said roll comprising the step of perforating said roll between said selected lengths.

16. The method of claim 1 wherein said selected length represents a single label.

17. A method of identifying piping systems covered by insulation having an outer jacket comprising the steps of:

providing a selected length of conventional pipe insulation tape suitable for primarily adhering to said outer layer of said insulation tape, said tape having an exterior layer with a front side and a back side and made of material substantially the same as the outer jacket of said pipe insulation, an adhesive layer for permanently adhering said tape to said outer jacket of said pipe insulation coextensive and releasably adhered to said back side of said exterior layer and a peel-off backing coextensive with said outer layer and said adhesive layer covering said adhesive layer;

placing a multiplicity of selected identification marking on said outer layer of insulation tape;

cutting a portion of said selected length with at least one of said multiplicity of markings prior to said removing and adhering steps; and removing said peel-off backing from said adhesive layer and permanently adhering said length of insulation tape with at least one selected identification marking to said outer jacket at a selected location of said insulation covering said piping system.

18. The method of claim 17 wherein said step of placing identification markings on said front side of said exterior layer is by a conventional printing technique.

19. The method of claim 18 wherein said printing technique is roll printing.

20. The method of claim 18 wherein said printing technique is screen printing.

21. The method of claim 18 wherein said printing technique is sheet printing.

22. The method of claim 18 wherein said printing technique is digital printing.

23. The method of claim 17 wherein said exterior layer is kraft paper.

24. The method of claim 17 wherein said exterior layer is kraft paper bonded to aluminum foil.

25. The method of claim 17 wherein said identifying markings are letters.

26. The method of claim 17 wherein said identifying markings are directional arrows.

27. The method of claim 17 wherein said identifying markings are a combination of letters and flow arrows.

* * * * *